US006053852A

United States Patent [19]

Wilkinson

[11] Patent Number: 6,053,852

[45] Date of Patent: Apr. 25, 2000

[54] ENERGY EXPENDITURE GARMENT

[76] Inventor: William T. Wilkinson, P.O. Box 73, Salem, N.J. 08079

[21] Appl. No.: 09/174,635

[22] Filed: Oct. 19, 1998

[51] Int. Cl.[7] ..... A63B 21/02; A41D 13/00

[52] U.S. Cl. ..... 482/127; 2/69; 482/121

[58] Field of Search ..... 2/69, 70, 456; 482/121, 124, 122

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 2,664,566 | 1/1954 | Mianulli . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,625,336 | 12/1986 | Derderian . | |
| 4,670,913 | 6/1987 | Morell . | |
| 4,698,847 | 10/1987 | Yoshihara . | |
| 4,850,056 | 7/1989 | Gardner et al. . | |
| 4,910,802 | 3/1990 | Malloy | 2/69 |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz . | |
| 5,060,315 | 10/1991 | Ewing . | |
| 5,062,642 | 11/1991 | Berry . | |
| 5,109,546 | 5/1992 | Dicker | 2/70 |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker | 2/70 |
| 5,203,754 | 4/1993 | Maclean . | |
| 5,256,119 | 10/1993 | Tudor . | |
| 5,263,916 | 11/1993 | Bobich . | |
| 5,267,928 | 12/1993 | Barile . | |
| 5,282,277 | 2/1994 | Onozawa . | |
| 5,306,222 | 4/1994 | Wilkinson . | |
| 5,308,305 | 5/1994 | Romney . | |
| 5,336,139 | 8/1994 | Miller . | |
| 5,357,637 | 10/1994 | Moore . | |
| 5,367,708 | 11/1994 | Fujimoto . | |
| 5,372,565 | 12/1994 | Burdenko . | |
| 5,375,610 | 12/1994 | Lacourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker . | |
| 5,659,895 | 8/1997 | Ford, Jr. . | |
| 5,913,408 | 6/1999 | Shanahan | 2/90 |

*Primary Examiner*—Jerome Donnelly
*Attorney, Agent, or Firm*—Connolly Bove Lodge & Hutz, LLP

[57] ABSTRACT

An energy expenditure garment includes at least one elastic ring section secured to the base fabric of the garment. The elastic ring section is made of a material which applies a greater longitudinal resistance force to the body of the wearer than the material of the base fabric. The base fabric is located longitudinally outwardly of the ring section so that there are alternating regions of differing longitudinal resistive characteristics.

27 Claims, 2 Drawing Sheets

ENERGY EXPENDITURE GARMENT

BACKGROUND OF THE INVENTION

Various garments have been suggested which involve elastic elements to provide a resistance to an activity which would require the swinging or bending of the arms and/or legs and/or body. Generally, such elastic elements are elastic cords or bands which are separate from the remainder of the garment, but are otherwise attached to the garment or the elastic elements are in the form of elastic panels which are integral with the remainder of the garment. Examples of such garments described in patents are found in U.S. Pat. Nos. 5,109,546, 5,176,600, 5,186,701, 5,201,074, 5,306,222, 5,570,472, 5,700,231, 5,708,976, 5,727,254, 5,737,772, 5,737,773 and 5,745,917. Additional disclosures of such garments are found in various U.S. patent applications, namely, U.S. Ser. No. 08/834,887, filed Apr. 7, 1997, U.S. Ser. No. 08/840,917, filed Apr. 25, 1997, U.S. Ser. No. 08/880,715, filed Jun. 23, 1997, U.S. Ser. No. 08/892,669, filed Jul. 14, 1997, U.S. Ser. No. 08/922,256, filed Aug. 25, 1997, U.S. Ser. No. 08/929,945, filed Sep. 15, 1997, U.S. Ser. No. 08/944,517, filed Oct. 6, 1997, U.S. Ser. No. 08/962,721, filed Nov. 3, 1997, U.S. Ser. No. 08/975,450, filed Nov. 21, 1997, U.S. Ser. No. 08/986,521, filed Dec. 8, 1997, U.S. Ser. No. 09/083,830, filed Mar. 12, 1998 and U.S. Ser. No. 09/151,840, filed Sep. 11, 1998.

My U.S. Pat. No. 5,720,042 discloses the provision of elongated longitudinal resistance elements, such as bands or cords, in combination with compression rings. That patent discloses the use of such compression rings or compression cuffs as anchor members for the elongated resistance elements.

SUMMARY OF THE INVENTION

An object of this invention is to provide an energy expenditure garment which incorporates elastic rings as the longitudinal resistance elements.

In accordance with this invention, the energy expenditure garment includes a body portion having limb portions such as arms or legs. The garment is essentially made of a base fabric for both the body portion and limb portions. There is, however, provided at least one elastic ring section secured to the base fabric preferably between sections of the base fabric. The ring section is made of a material that applies a longitudinal resistance force to the body of the wearer greater than any resistance force that might be applied by the base fabric. Thus, the garment provides alternating regions having differing longitudinal resistance characteristics.

The elastic ring section may form a closed ring which completely circumscribes a portion of the body or may be an open ring having spaced ends with the base material between the spaced ends. Alternatively, the elastic ring section may be formed from a series of spaced strips which in combination circumscribe the portion of the body. The ring section may be located at various portions of the garment such as an abdominal ring, an elbow ring, a shoulder ring, a forearm ring, a thigh ring, a knee ring or a lower leg ring.

THE DRAWINGS

FIG. 1 is a front elevational view of an energy expenditure garment in accordance with this invention; and FIGS. 2–11 are fragmental elevational views of alternative form s of garments in accordance with this invention.

DETAILED DESCRIPTION

Figure 1:
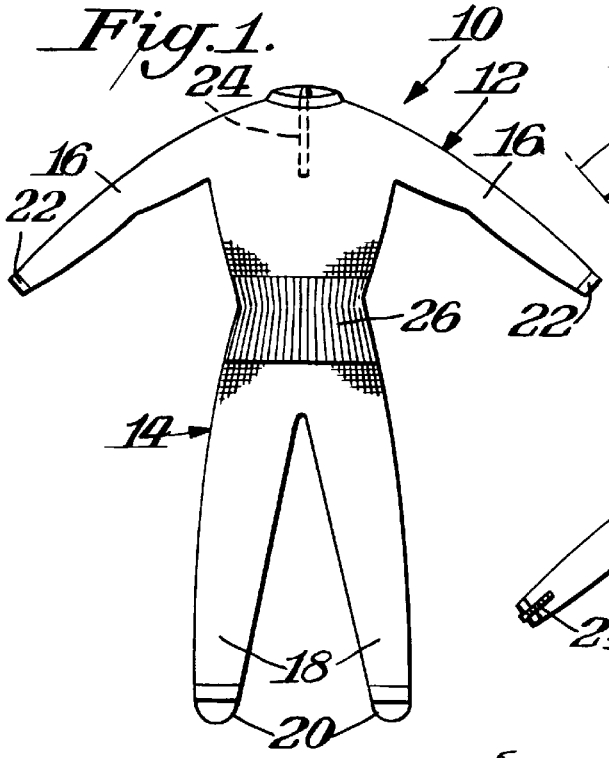

The present invention is directed to techniques for achieving longitudinal resistance in an exercise garment by the use of elastic compressive material incorporated in the garment as a section circumferentially around a portion of the wearer. Such sections of the garment could be used by itself or in combination with elongated longitudinal resistance bands or cords that extend longitudinally along the limbs or across the back or chest.

Heretofore, resistance has been primarily achieved by elastic bands that extend longitudinally along the arms or legs. The general approach is to provide some anchor structure for these longitudinal resistance elements. My U.S. Pat. No. 5,720,042 discloses techniques which incorporate compressive cuffs as the anchor elements. The present invention provides a garment that uses elastic structures which extend around the limbs or body portions of the user and garment in a circumferential direction, rather than longitudinally. The elastic structures or sections could extend completely around a portion of the user's body to form a closed ring or partially around the user's body to form an open ring having spaced ends separated from each other by the base fabric. The rings, whether completely closed or partially open, are joined to the garment on each side to provide an elastic resistance effect. The garment can include other longitudinal elastic resistance shapes or structures such as bands, cords, strips or straps.

A characteristic in a practice of the invention is that the elastic ring sections primarily apply a longitudinal resistance as distinguished from the compressive cuffs disclosed in my U.S. Pat. No. 5,720,042. Base fabric is located longitudinally outwardly of the elastic ring section with the base fabric applying less longitudinal resistance force than the elastic ring section. This results in alternating regions of different resistance characteristics circumferentially around parts of the body.

The elastic ring structure generally does not extend primarily only longitudinally on the limbs or body portion. Rather, the ring section is circumferential. Preferably, the elastic ring section does not extend a long distance, but is confined to a smaller area and completely or partially encircles a limb or portion of the body usually at a right angle of the limb movement. For example, each ring section would preferably encircle less than half the length of a limb. Generally, each elastic ring section is longitudinally displaced from the limb extremity.

The invention could be used with garments which are loose fitting or skin tight compression garments. The garments could be of one piece construction such as a body suit with arms and legs as part of an integral shirt and pants or the garments could be of more than one piece such as of two piece construction having a pant section and a shirt section which may be completely separate from each other or may be detachably secured together. The garments could include anchor points or anchor structure or could omit anchor structure. In the preferred practice of the invention anchor structure is used. The base fabric is preferably of non-elastic material. The garment could be of the types disclosed in the above noted patents and applications, all of the details of which are incorporated herein by reference thereto.

FIG. 1 illustrates a garment 10 in accordance with this invention. As shown therein the garment includes a top or shirt portion 12 and bottom or pants portion 14. The shirt portion 12 has arms 16 while the pants portion 14 has legs 18. If desired, stirrups 20 could be provided to anchor the legs while cuffs 22 could be provided to anchor the arms. A zipper 24 or other fastening structure could be used to facilitate the wearer putting on or taking off garment 10. The shirt portion 12 and pants portion 14 are made of a base fabric but are joined together by an elastic abdominal ring 26. This ring section 26 is made of a material which applies a longitudinal resistance force to the body of the user in response to movement of the body. Elastic ring section 26 may be made of any suitable elastic material such as various forms of spandex and preferably LYCRA®. The base fabric used in the garment 10 may also be made of any suitable material such as the various materials disclosed for base fabric in the above noted patents and applications. The base fabric could either be non-elastic or could have some degree of elasticity but would have a longitudinal resistance force less than the longitudinal resistance force or characteristics of the elastic ring section. Thus, greater force is required to longitudinally stretch the elastic ring section 26 and a greater elastic longitudinal force would result when the material of ring section 26 tends to return to its original condition.

Figure 2:
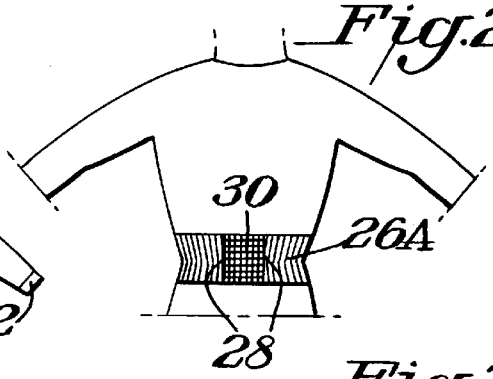

FIG. 2 illustrates an alternative wherein the elastic abdominal ring 26A does not extend completely around the body, but rather has a pair of free ends 28,28 spaced from each other and being interconnected by base fabric 30. Base fabric 30 could have the same longitudinal resistance characteristics as other portions of base fabric in the garment or could have greater or lesser longitudinal resistance characteristics.

While FIGS. 1–2 show the body portion of the garment to include an abdominal ring section, similar ring sections could circumscribe other parts of the body. Thus, for example, the garment could include a chest ring instead of or in addition to the abdominal ring.

Figure 3:
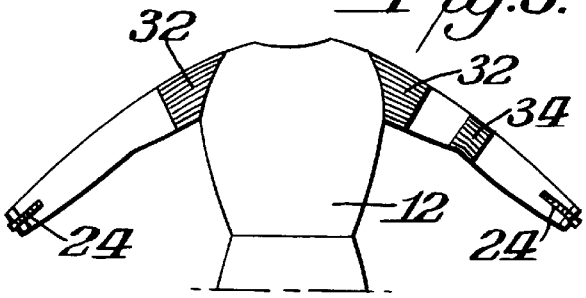

FIG. 3 illustrates a garment wherein the shirt portion 12 is provided with elastic resistance shoulder rings 32 which are separated from each other by the base fabric in shirt 12. FIG. 3 also shows the option wherein the elastic ring section is an elbow ring 34. Such an elbow ring could be provided on each arm or sleeve in addition to or instead of the shoulder rings. Similarly, a shoulder ring could be provided on one or both shoulders. FIG. 3 further illustrates the inclusion of zippers 24 to facilitate the user inserting or removing the arms from the garment.

Figure 4:
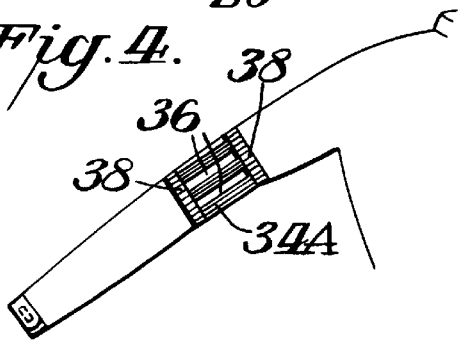

FIG. 4 illustrates a variation of elbow ring 34A which does not extend completely around the elbow, but rather includes spaced strips separated by base fabric 36. The strips may be joined together by upper and lower rings 38 which could be made of the same material as the strips for ring 34A.

Figure 5:
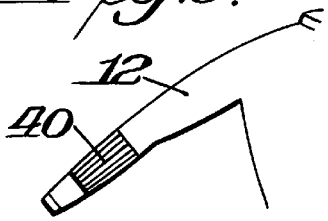

FIG. 5 illustrates an elastic ring section 40 which is located on the forearm of a shirt 12. As with the other elastic ring sections, the forearm ring 40 may extend completely around and encircle the forearm or may only partially encircle the forearm such as being made from spaced strips (as in FIG. 4) or from an open ring having its two ends spaced from each other and connected by base fabric (as in FIG. 2).

Figure 6:
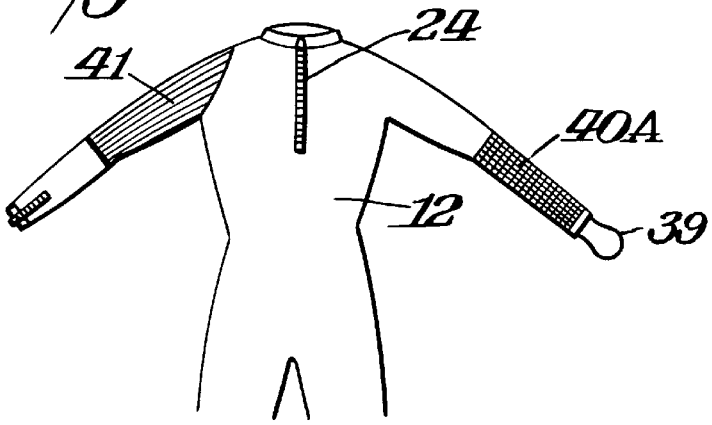

FIG. 6 shows a variation of the invention wherein the shirt 12 includes a forearm ring 40A and an upper arm ring 41 which are made to cover larger portions of the limb than the prior described rings. Thus, forearm ring 40A could cover all or almost all of the forearm from the wrist to the elbow and upper arm ring 41 could extend from the shoulder to the elbow or even beyond the elbow. Forearm ring 40A could be anchored to hand loop 39 or could have base fabric at the extremity of the sleeve without being anchored.

Figure 10:
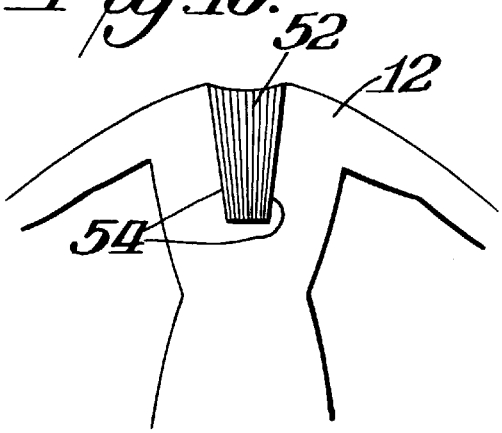
Figure 11:
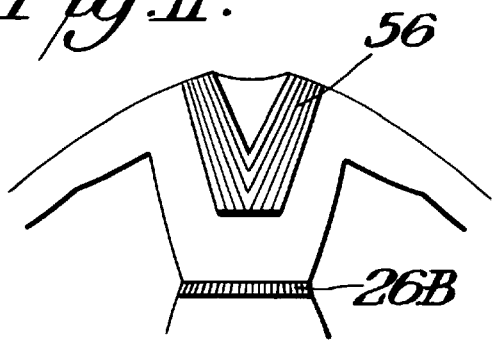
Figure 9:
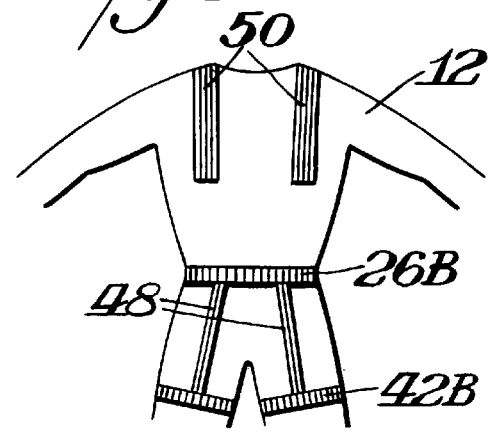
Figure 7:
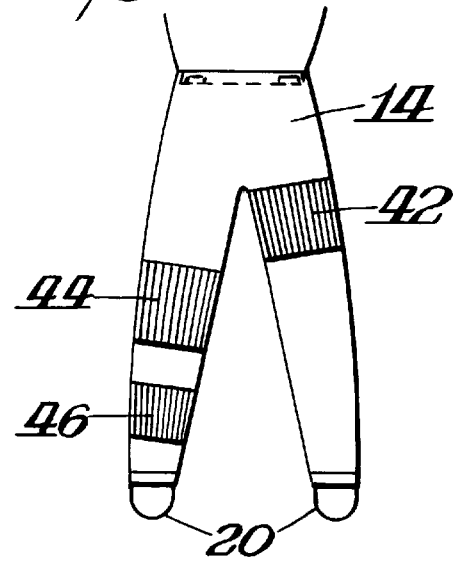
Figure 8:
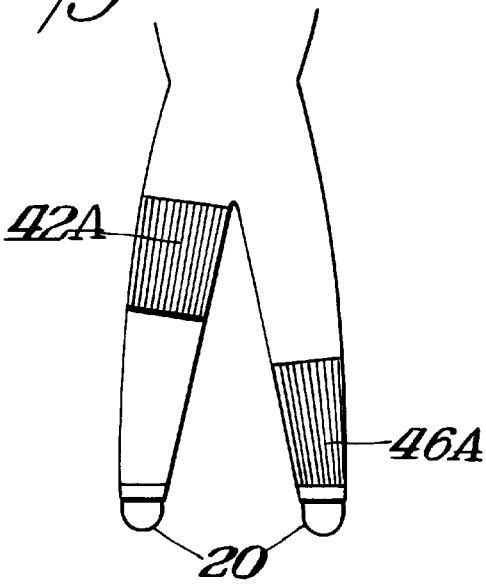

While the prior description with regard to FIGS. 3–6 has been directed to various forms of elastic ring sections on various parts of the shirt, the concept of this invention may also be applied to other parts of the garment. FIGS. 7–9, for example, illustrate various elastic ring sections in the pants portion of the garment, while FIGS. 9–11 illustrate the inclusion of elastic panels in the body portion of the garment.

FIG. 7 shows other alternative locations for the elastic ring sections. Specifically, FIG. 7 illustrates an elastic resistance upper leg or thigh ring 42 and an elastic resistance knee ring 44, as well as an elastic resistance lower leg ring 46 which could be located at the calf above the ankle. These various rings in the pants 14 could be used in sets where, for example, each leg would have the same number and location of rings as the other leg or could be used where different rings are applied on each leg.

FIG. 8 shows a variation wherein the upper leg ring 42A is longer than the ring 42 and the lower leg ring 46A is longer than the ring 46. Each of these longer ring sections could completely encircle, for example, the entire upper leg and lower leg respectively. Ring 46A could be anchored to stirrup 20.

It is to be understood that in each of these embodiments the various ring sections could be made from a closed ring which completely encircles its portion of the body or from a partial ring. Where the ring is a partial ring, it could be made from a ring section having spaced ends interconnected by the base fabric, as shown in FIG. 2, or could be made from a plurality of spaced strips or bands, as shown in FIG. 4, with intermediate portions of base fabric and with the ends of the bands interconnected by the elastic material having the same characteristics of the elastic strips or bands or by material of different longitudinal elastic characteristics. Alternatively, such end rings could be omitted.

Preferably, a closed ring would be used. Thus, partial rings should preferably come close to comprising a closed ring. It is to be understood, however, that having open areas in the partial ring may still be within the practices of this invention. Where the various ring sections do not form a closed ring, but have open areas, such as illustrated in FIGS. 2 and 4, the elastic longitudinal resistance material of the ring section should occupy a significant portion of the circumscribed limb/body such as at least ¼ or ⅓ of the portion of the circumscribed limb/body. Preferably, the elastic material of the ring section should cover at least half and more preferably at least ¾ or 90% of the area of that portion of the body or garment where the ring section is located.

FIG. 9 shows a variation of the invention wherein an abdominal ring 26B is provided which is interconnected to thigh rings 42B by longitudinal elastic resistance bands 48. Such resistance bands 48 may be of the type described in the various previously noted patents and applications. The purpose of illustrating the bands 48 in FIG. 9 is to make clear that the invention may be practiced where elastic ring sections are used in combination with longitudinal elastic resistance bands. One or more longitudinal spaced bands 48 may be connected to a ring section or may interconnect two ring sections.

FIG. 9 also illustrates a practice of the invention wherein the body portion includes spaced longitudinal elastic panels 50 which could be provided on the back end or front portion of the garment.

FIG. 10 shows a variation wherein a single central panel 52 is provided of generally closed V-shape having edges 54 which converge toward each other in a direction away from the neck. The center panel 52 is preferably made of material having longitudinal resistance characteristics and could be at the back or front of the shirt 12.

FIG. 11 shows a variation wherein the center elastic panel 56 is of open V-shape and could be at the front or back of the garment.

While the elastic ring sections may be anchored such as through the use of stirrups, compressive cuffs or hand loops, such anchor structure could be omitted in the practice of this invention. Reference is made to application Ser. No. 09/151,840 which discloses techniques which omit anchor structure.

It is to be understood that various features shown in any one embodiment may be used in other embodiments.

What is claimed is:

1. An energy expenditure garment comprising a body portion and limb portions, said body portion being made of a base fabric, said limb portions being made of a base fabric, each of said body portion and said limb portions having a longitudinal axis, at least one elastic ring section in at least one of said body portion and said limb portions of said garment secured to said base fabric inwardly of the extremity of said at least one of said body portion and said limb portions and extending circumferentially around said at least one of said body portion and said limb portions of said garment to thereby be capable of extending around the body of a wearer in a circumferential direction, said circumferential direction being perpendicular to said longitudinal axis of said at least one of said body portion and said limb portions, said elastic ring section being coplanar with said base fabric, said elastic ring section being made of a material which applies a longitudinal resistance force to the body of the wearer, said base fabric being secured to said elastic ring section longitudinally outwardly of said elastic ring section, and said base fabric being made of a material which applies less longitudinal resistance force than said elastic ring section to provide alternating regions of differing longitudinal resistive characteristics in said garment.

2. The garment of claim 1 wherein said elastic ring section is a closed ring section.

3. The garment of claim 1 wherein said elastic ring section is a partial ring section having open areas, and said base fabric being in said open areas.

4. The garment of claim 1 wherein said elastic ring section is an abdominal ring.

5. The garment of claim 1 wherein said elastic ring section is a shoulder ring.

6. An energy expenditure garment comprising a body portion and limb portions, said body portion being made of a base fabric, said limb portions being made of a base fabric, at least one elastic ring section in said garment secured to said base fabric and extending circumferentially around said garment to thereby be capable of extending around the body of a wearer in a circumferential direction, said elastic ring section being made of a material which applies a longitudinal resistance force to the body of the wearer, said base fabric being secured to said elastic ring section longitudinally outwardly of said elastic ring section, said base fabric being made of a material which applies less longitudinal resistance force than said elastic ring section to provide alternating regions of differing longitudinal resistive characteristics in said garment, said elastic ring section is an elbow ring.

7. An energy expenditure garment comprising a body portion and limb portions, said body portion being made of a base fabric, said limb portions being made of a base fabric, at least one elastic ring section in said garment secured to said base fabric and extending circumferentially around said garment to thereby be capable of extending around the body of a wearer in a circumferential direction, said elastic ring section being made of a material which applies a longitudinal resistance force to the body of the wearer, said base fabric being secured to said elastic ring section longitudinally outwardly of said elastic ring section, said base fabric being made of a material which applies less longitudinal resistance force than said elastic ring section to provide alternating regions of differing longitudinal resistive characteristics in said garment, said elastic ring section is an forearm ring.

8. The garment of claim 1 wherein said elastic ring section is an upper leg ring.

9. The garment of claim 1 wherein said elastic ring section is a knee ring.

10. The garment of claim 1 wherein said elastic ring section is a lower leg ring.

11. The garment of claim 1 wherein said garment includes body panels located on said body portion and made of material having the same longitudinal resistance characteristics at said elastic ring section.

12. The garment of claim 11 wherein said body panel comprises a pair of spaced panels.

13. The garment of claim 11 wherein said body panel comprises a closed V-shaped panel.

14. The garment of claim 11 wherein said body panel comprises an open V-shaped panel.

15. The garment of claim 1 wherein said garment includes a shirt having said limb portions, and a set of said elastic ring sections being on each of said limb portions.

16. An energy expenditure garment comprising a body portion and limb portions, said body portion being, made of a base fabric, said limb portions being made of a base fabric, at least one elastic ring section in said garment secured to said base fabric and extending circumferentially around said garment to thereby be capable of extending around the body of a wearer in a circumferential direction, said elastic ring section being made of a material which applies a longitudinal resistance force to the body of the wearer, said base fabric being secured to said elastic ring section longitudinally outwardly of said elastic ring section, said base fabric being made of a material which applies less longitudinal resistance force than said elastic ring section to provide alternating regions of differing longitudinal resistive characteristics in said garment, said garment includes a pant having said limb portions, and a set of said elastic ring sections being on each of said limb portions.

17. The garment of claim 1 wherein a plurality of said elastic ring sections is provided on said garment.

18. The garment of claim 1 wherein said base fabric is located on each side of said elastic ring section longitudinally outwardly of said elastic ring section on each side thereof.

19. The garment of claim 3 wherein said elastic ring section circumscribes at least one half of the circumferential area of the body where said ring section is located.

20. The garment of claim 19 wherein said elastic resistance material comprises at least three-fourths of said elastic ring section.

21. The garment of claim 1 wherein said ring section is spaced from the extremity of said limb portion.

22. The garment of claim 1 including a plurality of said ring sections.

23. An energy expenditure garment comprising a body portion and limb portions, said body portion being made of a base fabric, said limb portions being made of a base fabric, at least one elastic ring section in said garment secured to said base fabric and extending circumferentially around said garment to thereby be capable of extending around the body of a wearer in a circumferential direction, said elastic ring section being made of a material which applies a longitudinal resistance force to the body of the wearer, said base fabric being secured to said elastic ring section longitudinally outwardly of said elastic ring section, said base fabric being made of a material which applies less longitudinal resistance force than said elastic ring section to provide alternating regions of differing longitudinal resistive characteristics in said garment, a plurality of said ring sections, and at least one longitudinal resistance band interconnecting said ring sections.

24. An energy expenditure garment comprising a body portion and limb portions, said body portion being made of a base fabric, said limb portions being made of a base fabric, at least one elastic ring section in said garment secured to said base fabric and extending circumferentially around said garment to thereby be capable of extending around the body of a wearer in a circumferential direction, said elastic ring section being made of a material which applies a longitudinal resistance force to the body of the wearer, said base fabric being secured to said elastic ring section longitudinally outwardly of said elastic ring section, said base fabric being made of a material which applies less longitudinal resistance force than said elastic ring section to provide alternating regions of differing longitudinal resistive characteristics in said garment, and anchor structure connected to said ring section.

25. The garment of claim 1 wherein said ring section is non-anchored.

26. The garment of claim 1 wherein said ring section covers less than the entire area of said limb portion.

27. The garment of claim 26 wherein said ring section covers less than one-half of the length of said limb portion.

* * * * *